US005809625A

United States Patent [19]

Young et al.

[11] Patent Number: 5,809,625

[45] Date of Patent: Sep. 22, 1998

[54] APPARATUS AND METHOD FOR LOWERING A BURIAL VAULT AND CASKET

[75] Inventors: Lewis P. Young; John J. Bagwell; Jeff A. Bagwell, all of Greenville, S.C.

[73] Assignee: Guaranteed Seal System, Greenville, S.C.

[21] Appl. No.: 574,570

[22] Filed: Dec. 15, 1995

[51] Int. Cl.[6] ..... A61G 19/00

[52] U.S. Cl. ..... 27/32; 27/26

[58] Field of Search ..... 27/32, 33, 34, 27/26; 414/786

[56] References Cited

U.S. PATENT DOCUMENTS

| | | | |
|---|---|---|---|
| 1,791,341 | 2/1931 | Bancroft . | |
| 2,028,442 | 1/1936 | Dormer . | |
| 2,040,220 | 5/1936 | Thomas | 27/32 |
| 2,817,138 | 12/1957 | Merz | 27/26 |
| 2,918,718 | 12/1959 | Oberwegner . | |
| 3,095,066 | 6/1963 | Abplanalp, Jr. . | |
| 3,364,536 | 1/1968 | Williams | 27/32 |
| 3,762,580 | 10/1973 | Melsek | 414/786 X |
| 4,221,515 | 9/1980 | Brown et al. | 414/786 X |
| 4,413,390 | 11/1983 | Blaese et al. . | |

*Primary Examiner*—Kien T. Nguyen
*Attorney, Agent, or Firm*—Hardaway Law Firm P.A.

[57] ABSTRACT

A burial service system (10), which is provided for both lowering a casket into a burial vault and lowering the casket-containing burial vault into a grave, comprises a first burial service unit (12) and a separate and distinct second burial service unit (14). When in use, the units are longitudinally spaced from one another across a grave and are interconnected by a flexible casket support (16) extending longitudinally over a burial vault opening and a flexible vault support (18) extending longitudinally across the grave. Referring to the first unit (12), each burial service unit includes a housing (12*a), a first shaft (*68) journaled in the housing, a first automatic drive system operatively connected to the first shaft, a flexible casket support member (20) carried by the first shaft, a second shaft (96) journaled in the housing, a second automatic drive system operatively connected to the second shaft, and a flexible vault support member (28) carried by the second shaft.

10 Claims, 17 Drawing Sheets

APPARATUS AND METHOD FOR LOWERING A BURIAL VAULT AND CASKET

BACKGROUND OF THE INVENTION

This invention is directed to an apparatus and method for both lowering a casket into a burial vault and lowering the casket-containing burial vault into a grave. The invention also contemplates, among other things, a method of transporting a burial vault using the lowering apparatus and of positioning a vault cover onto the vault in a dignified manner after the casket has been completely lowered into the vault.

The lowering of a casket into a burial vault during a burial service, as well as the required preparation for that task, presents several problems. Heretofore, prior to properly positioning a casket lowering system for use, the burial vault has first had to be transported to the grave site independently of the casket lowering system and either completely lowered into the grave or elevated onto a platform by a separate apparatus, depending on the desired sequence of the burial service. Such preparatory tasks exhaust a significant amount of time and increase logistical complexity of assuring that all separate items required for the burial service have been timely transported to a particular grave site. Moreover, the ground in which a grave is dug may be sloped, requiring one end of the burial vault to be lifted independently of the other to conform to the slope for gentle placement into the grave; the same problem occurs when trying to lower a casket into the vault placed into such a grave. Additionally, once the casket has been completely lowered into the vault, the vault cover must presently be lifted, properly positioned over the vault opening, and placed onto the vault, requiring skilled labor and proving to be a somewhat awkward stage of a burial service.

Various means for lowering a vault or a casket into the vault or a grave are known in the art.

For instance, U.S. Pat. No. 4,413,390 to Blaese et al. discloses a casket lowering device comprising a single frame provided with rotatable side rails upon which supporting arms and strap members extending laterally of the vault opening are mounted. When a casket is placed onto the arms and latching means are released, the arms rotate downwardly to transfer the weight of the casket to the strap members, whereupon the casket is lowered into a vault or grave. Electromechanical control and braking means govern both the speed of downward rotation of the supporting arms and the speed of descent of the supported casket. While the disclosed device may be deemed suitable for its intended purpose, several problems remain unresolved. Specifically, there is no disclosed means for lowering a vault into the grave, nor a means for lowering or raising one casket end independently of the other end. Additionally, use of the disclosed device is restricted to instances where a vault has already been completely lowered into the grave. Furthermore, the noted vault-unit transport problems and cover placement problems persist.

U.S. Pat. No. 2,028,442 to Dormer discloses a load handling device particularly adapted to lower a vault into a grave and to subsequently lower a casket into the vault. Longitudinal shafts mounted on opposed sides of a supporting frame carry swivel supports and laterally extending straps, constituting a casket lowering structure similar to that disclosed by Blaese et al.; the same longitudinal shafts also carry chain sheaves to enable lowering of a vault by chains passing over the sheaves, the chains each having a hook at their free ends. Such chains may also lower a vault cover into the grave to seal the vault. While achieving the dual function of lowering both a vault and a casket, the disclosed device nevertheless presents certain drawbacks. The casket lowering system, being similar to that disclosed by Blaese et al., is subject to the same limitations observed with regard to that reference. Moreover, separate eyelets must be inserted into the vault base to make the vault compatible with the disclosed lowering system, and precise alignment of a vault cover suspended above a fully-lowered vault presents difficulty, owing to the size of the initial gap between the suspended cover and the top of the lowered vault.

Other devices illustrative of the art include that disclosed in U.S. Pat. No. 3,095,066 to Ablpanalp, Jr., which teaches hydraulic braking means controlling the rate of descent of a casket supported by ropes passing over pulleys slidably mounted to a frame, and in U.S. Pat. No. 1,791,341 to Bancroft, teaching a burial unit for use with a burial casket and a removable, open-bottom enclosing casket.

Accordingly, significant room for improvement is present in the art.

SUMMARY OF THE INVENTION

It is thus an object of the present invention to provide an apparatus and method for lowering a burial vault and a casket which overcomes the limitations associated with prior art devices.

It is another object of the present invention to provide an apparatus for lowering a burial vault and a casket which comprises two separate and distinct burial service units.

It is a further object of the present invention to provide an apparatus and method for lowering a burial vault and a casket which enables one end of a vault or casket to be elevated independently of the other end of the vault or casket.

It is a further object of the present invention to provide an apparatus and method for lowering a burial vault and a casket which enables lowering of a casket into a vault which has been only partially lowered into a grave.

It is a still further object of the present invention to provide an apparatus and method for lowering a burial vault and a casket which can accommodate vaults and caskets of widely varying sizes.

It is a still further object of the present invention to provide an apparatus and method for lowering a burial vault and a casket which enables a vault cover to be placed onto a vault in a dignified manner during a burial service.

It is a still further object of the present invention to provide an apparatus and method for lowering a burial vault and a casket which allows the apparatus operator to guarantee correct closure of a burial vault.

It is a still further and more particular object of the present invention to provide an apparatus for lowering a burial vault and a casket which is readily transportable with a burial vault as a composite body.

These as well as other objects are accomplished by a burial service unit, comprising a housing having an upper portion, a first shaft journaled in the housing, a first automatic drive system operatively connected to the first shaft, a flexible casket support member carried by the first shaft, a second shaft journaled in the housing, a second automatic drive system operatively connected to the second shaft, and a flexible vault support member carried by the second shaft.

The objects of the present invention are also accomplished by a method of lowering both a casket and a burial vault with a vault cover into a grave. A first unit and a second unit are provided, each unit comprising a housing having an upper portion, a first source carried by the housing, the first source dispensing a flexible casket support member, a second source carried by the housing, the second source dispensing a flexible vault support member, and a track assembly mounted atop the housing and being movable from a retracted position to an extended position. Subsequent steps contemplated by the method of the present invention include forming a vault support, the vault support including portions of flexible vault support members dispensed from each second source of each unit, placing the burial vault with the vault cover onto the vault support, positioning the first unit proximate one end of the grave and the second unit proximate another end of the grave, such that the first unit and the second unit are spaced from one another across the grave, and extending each track assembly to the extended position. A cover trolley is provided for each track assembly, each cover trolley being movable along each track assembly and adapted to engage the vault cover. Using this cover trolley in conjunction with the units, the operator then performs the steps of laterally aligning each cover trolley with respect to the burial vault, vertically positioning the burial vault such that a portion of each cover trolley extends into a gap between the burial vault and the vault cover, lowering the vault with vault cover such that the portion of each cover trolley engages the vault cover to prevent further descent of the vault cover, continuing to lower the vault for a time sufficient to separate the vault cover from the vault, and displacing the vault cover away from the burial vault with each cover trolley. The operator then extends a flexible casket support over an opening of the burial vault, the flexible casket support including portions of flexible casket support members dispensed from each first source of each unit. A casket is placed onto the flexible casket support, whereafter the casket is lowered into the vault. Next, the vault cover is displaced toward the grave with each cover trolley and is aligned over the burial vault opening, whereafter the burial vault is raised until it engages the vault cover, thereby providing a sealed burial vault. Finally, the sealed burial vault is lowered into the grave.

The present invention additionally contemplates a method of transporting to a grave a burial vault having upper corner sections, together with a vault cover and a burial service unit, comprising the steps of placing a spacer block assembly onto each upper corner section of the burial vault, each spacer block assembly comprising a solid block, a flexible member attached at one end to the solid block, and a hooked member attached to another end of the flexible member, placing the vault cover onto each spacer block assembly, providing the burial service unit with a housing having a side panel into which an aperture is formed, positioning the hooked member in the aperture to engage the side panel, hoisting the burial vault, whereby the burial vault, the vault cover, and the burial service unit are elevated together as a composite body, and transporting the composite body to the grave.

DETAILED DESCRIPTION OF THE PREFERRED EMBODIMENT

GENERAL OVERVIEW OF BURIAL SERVICE SYSTEM (FIGS. 5A & 13A)

Figure 5:
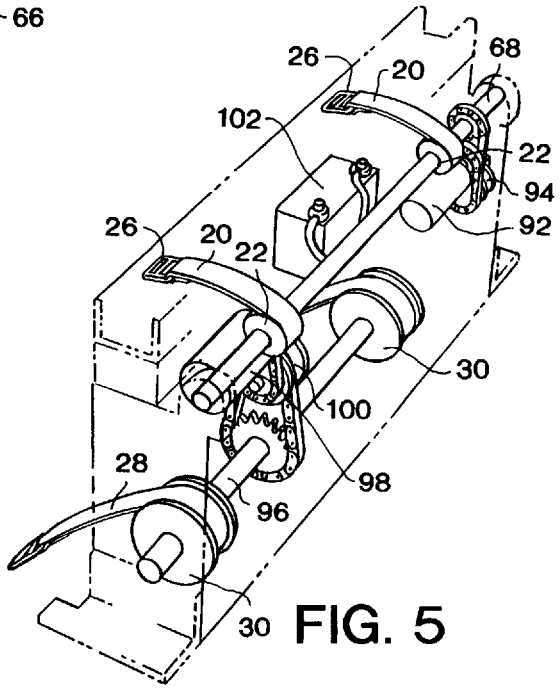
FIG. 5 is a perspective view showing the automatic drive systems housed within the burial service unit shown in FIG. 4.
Figure 5A:
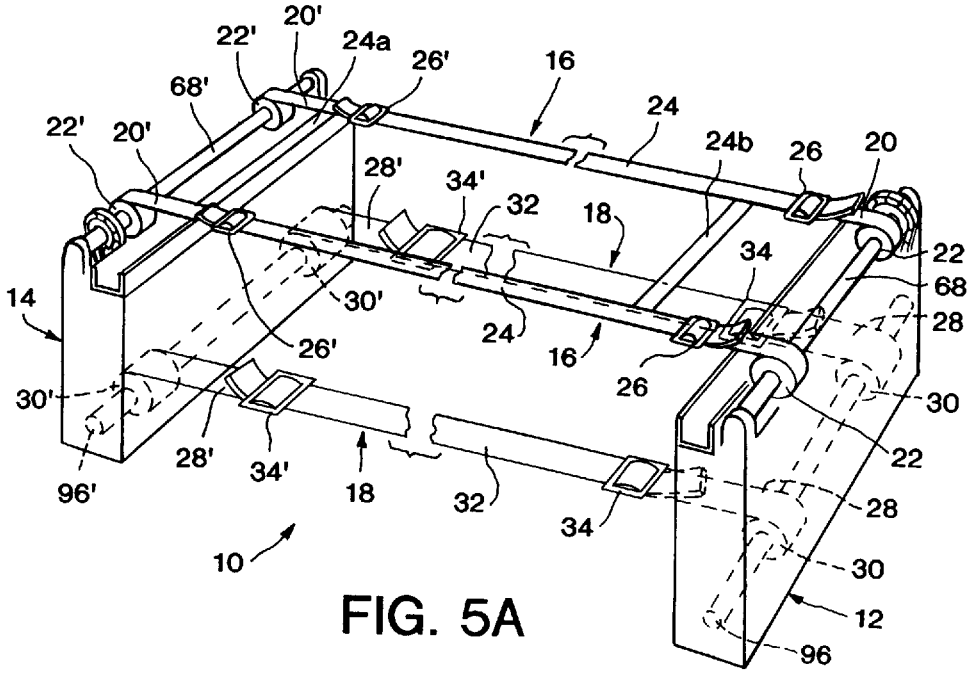
FIG. 5A is a perspective view illustrating components of a flexible casket support and of a flexible vault support.
Figure 13:
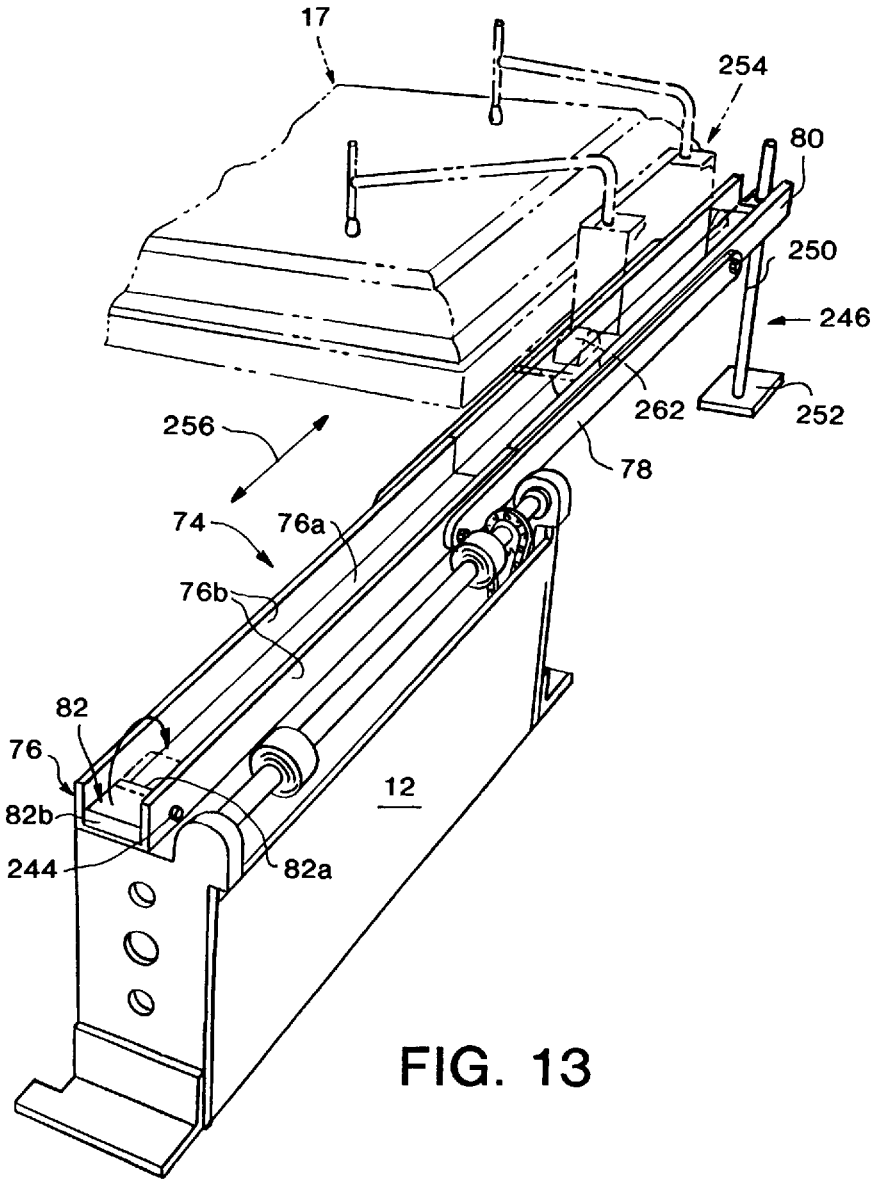
FIG. 13 is a perspective view of a deployed track assembly, the track assembly including a stop block and shown in relation to a cover trolley of the type illustrated in FIG. 9A.
Figure 13A:
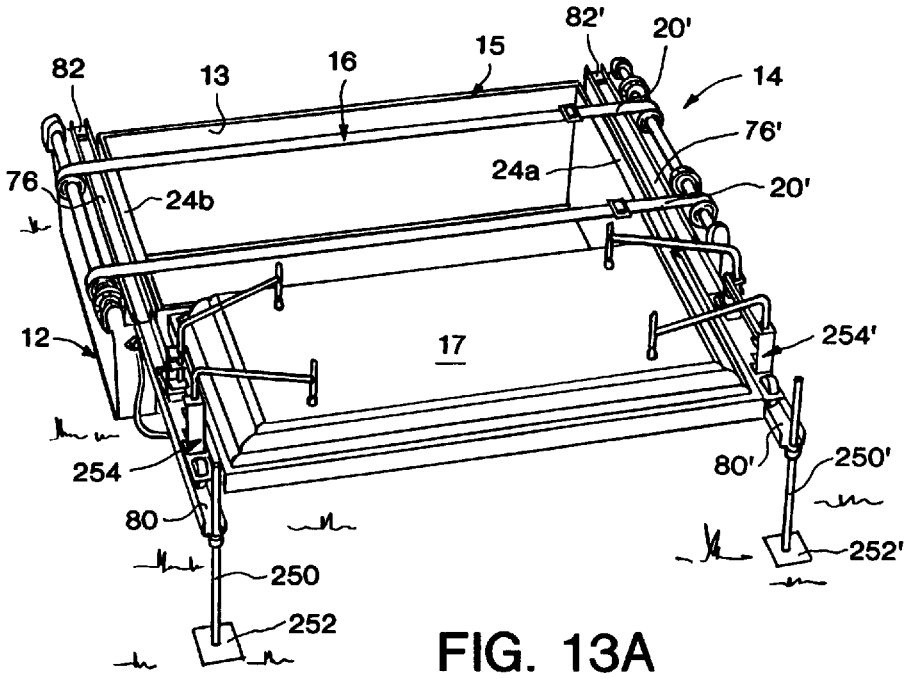
FIG. 13A is a perspective view of a pair of tracks of the type illustrated in FIG. 13, shown in conjunction with a vault cover move away from the opening of a burial vault preparatory to the placement of a casket on the flexible casket supports.

A burial service system 10 is generally indicated in FIG. 5A as comprising a first burial service unit 12 and a separate and distinct second burial service unit 14. When in use, units 12 and 14 are interconnected by a flexible casket support 16 and a flexible vault support 18. An operator using system 10 can both lower a burial vault into a grave and lower a casket into the burial vault. As best seen in FIG. 13A, units 12, 14 are adapted to be placed proximate opposite ends of a grave, such that the units 12, 14 are longitudinally spaced from one another across the grave and such that flexible casket support 16 extends longitudinally over an opening 13 of a burial vault 15 which has been partially lowered into the grave in a manner to be described in detail herein.

Casket support 16 (FIG. 5A) is comprised of flexible casket support members 20, 20' dispensed from corresponding sources 22, 22' in first burial service unit 12 and in second burial service unit 14, respectively. Preferably, members 20, 20' are interconnected to one another by a removable intermediate casket support member 24 via buckles 26, 26'. Flexible cross members 24*a*, 24*b* are attached to the flexible casket supports 16 to prevent separation thereof when a casket with rounded corners is placed thereon. More particularly, cross member 24*a* is attached at its ends to flexible casket support members 20, and cross member 24*b* is attached at its ends to each intermediate casket support member 24.

Similarly, vault support 18 is comprised of flexible vault support members 28, 28' dispensed from corresponding sources 30, 30' in first burial service unit 12 and in second burial service unit 14, respectively. Members 28, 28' are preferably interconnected to one another by a removable intermediate vault support member 32 via buckles 34, 34'. Unlike vault support 16, vault support 18 does not require flexible cross members in the preferred embodiment of the present invention.

First burial service unit 12 includes a first shaft 68 and a second shaft 96, while second burial service unit 14 includes a third shaft 68' and a fourth shaft 96'. These shafts will be described in greater detail herein with regard to FIGS. 4, 6, and 7A.

It is noted that the longitudinal positions of the buckles depicted in FIGS. 5A & 13A may not necessarily correspond to in-use, fully-tightened states of the flexible supports 16, 18; rather, segments of these supports are shown in a stretched condition only to more clearly illustrate the above-described interconnections between support members. Sequential positions of the buckles assumed during use of the system 10 are more clearly seen in FIGS. 8, 9, & 10–12, to be described in detail herein.

TRANSPORT OF BURIAL SERVICE SYSTEM (FIGS. 1, 2, 3, & 3A)

Figure 1:
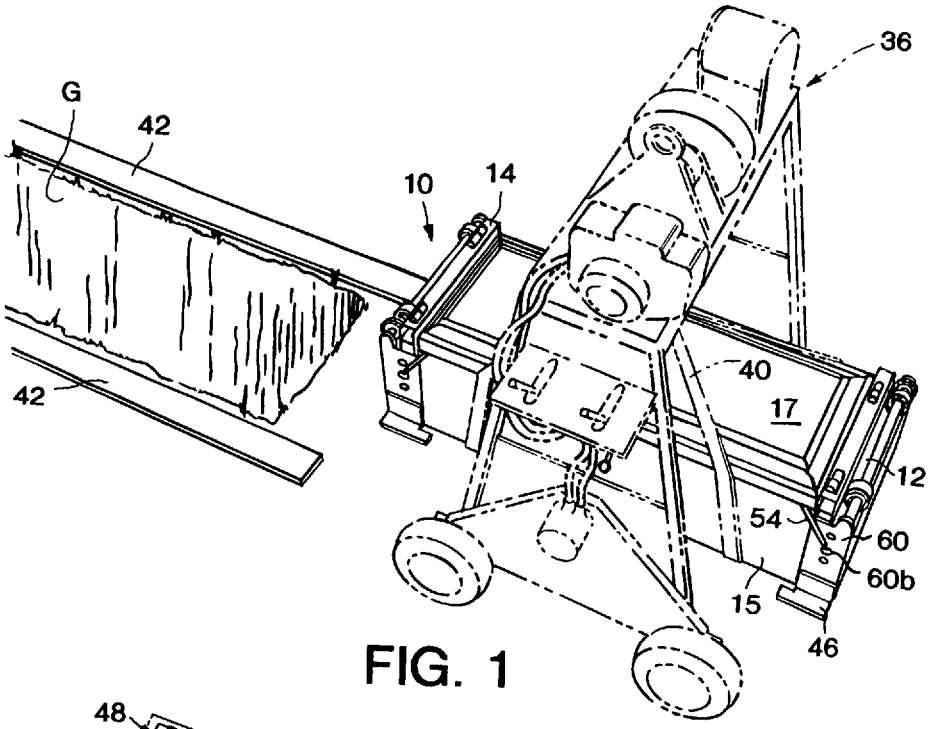
FIG. 1 is a perspective view depicting the transport to a burial site of an apparatus for lowering a burial vault and a casket constructed in accordance with a preferred embodiment of the present invention, together with a burial vault and vault cover, by a vault transport vehicle.
Figure 2:
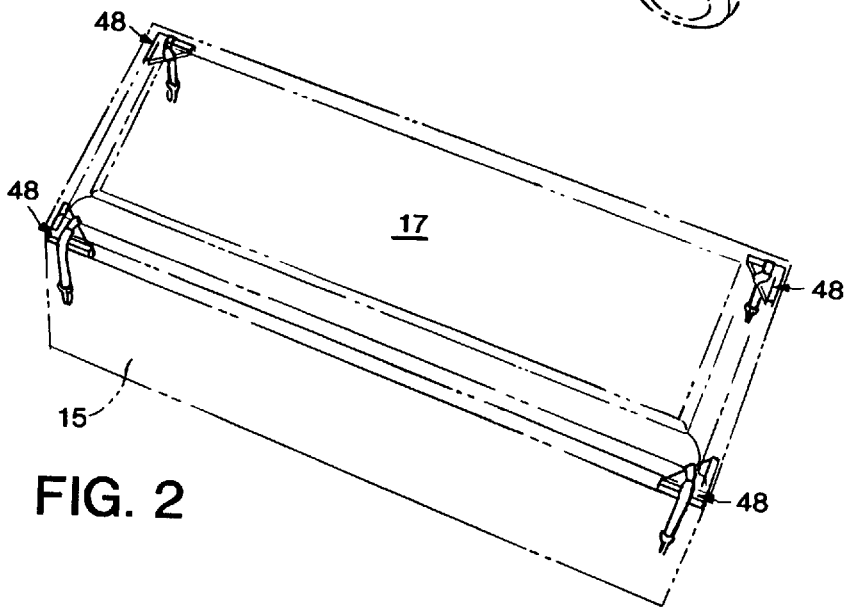
FIG. 2 is a perspective view illustrating spacer block assemblies positioned upon upper corner sections of a burial vault.
Figure 3:
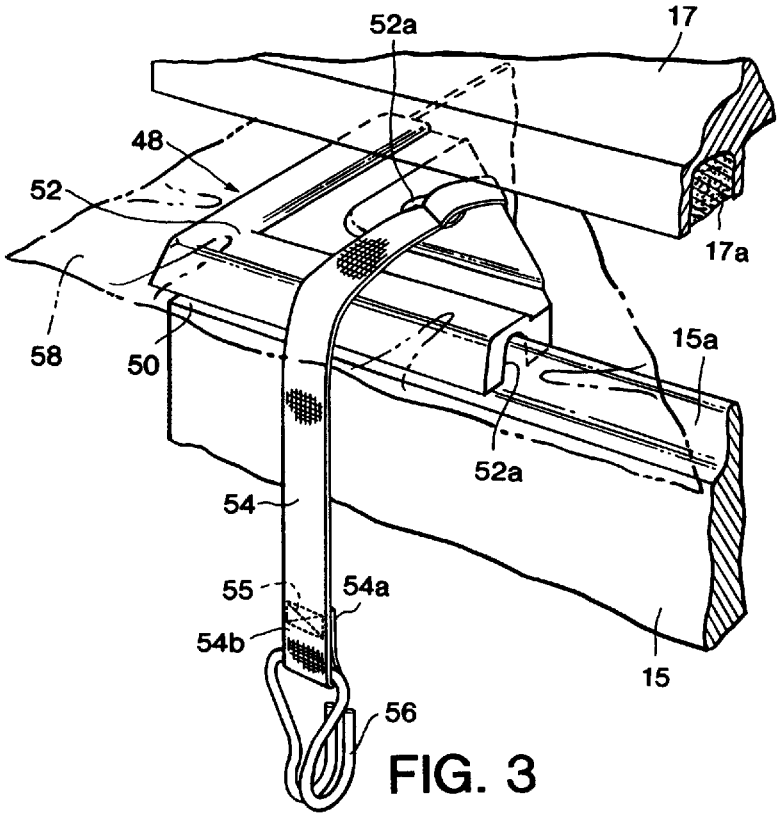
FIG. 3 is an enlarged perspective view of a spacer block assembly of the type illustrated in FIG. 2.

As seen in FIGS. 1–3, transport of the burial service system 10 may be accomplished easily and efficiently. FIG. 1 depicts such transport generally by use of a vault transport vehicle 36 marketed under the trademark GOOD BUDDY by Wilbert Burial Vault Company of Greenville, S.C. Vehicle 36 is seen to transport burial service units 12 and 14, vault 15, and a vault cover 17 together as a composite body, the term "composite body" meaning that the units 12 and 14, vault 15, and vault cover 17 form a single transport body to the extent that one need only hoist vault 15 such as with hoisting straps 40 passed therebeneath to also cause the hoisting of units 12 and 14 and of vault cover 17. Thus, the burial vault 15 carries system 10, as well as the vault cover 17, when the burial vault 15 is hoisted preparatory to and during transport. System 10 is carried by vault 15 via flexible members 54, as will be explained in greater detail below. Also shown in FIG. 1 are a pair of longitudinal bearing boards 42 placed alongside the grave G. These boards help distribute the weight of units 12, 14 more evenly as these units press against the boards through their footings 44, 46, respectively, when they are properly positioned with respect to the grave G.

Referring to FIGS. 2 & 3, spacer block assemblies 48 are placed on each upper corner section 50 of the burial vault 15. As best seen in FIG. 3, each spacer block assembly 48 comprises a preferably solid block 52, a flexible member 54 attached at one end to the block 52, and a hooked member 56 attached to another end of the flexible member 54. Block 52 is preferably notched as at 52*a* so as to mate with lip portion 15*a* of the burial vault 15, thereby restraining the block 52 against movement off of the upper corner section 50. Flexible member 54 may be attached to block 52 by providing an aperture 52*a* in the block 52, passing one of the ends of the flexible member 54 through the aperture 52*a*, and then by securing that end to another portion of the flexible member 54. Hooked member 56 is attached to the flexible member 55 in like manner; specifically, an opposite end 54*a* of member 54 is attached to portion 54*b* of member 54 such as by stitching 55, thereby forming a loop through which a portion of the hooked member passes.

Once each of the assemblies 48 is positioned in the manner described, the vault cover 17 is superposed onto the assemblies 48 as seen in FIG. 3. Preferably, a barrier such as a plastic-coated paper sheet 58 is placed between each assembly 48 and the vault cover 17 so as to avoid sealing of the burial vault 15 which may otherwise occur due to the nature of the sealing compound 17*a* lining the perimeter of the underside of the vault cover 17.

Figure 3A:
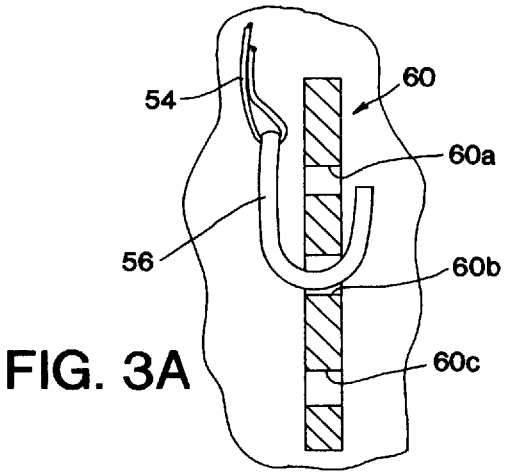
FIG. 3A is a side elevation view, taken partly in section, of a hooked member of a spacer block assembly engaging a side housing panel of a burial service unit by protruding into an aperture within the panel.

Each assembly 48 engages a burial service unit in the manner depicted in FIGS. 1 & 3A. Each burial service unit 12, 14 is provided with a housing having a side panel such as shown in FIG. 3A at 60. Into such a side panel are formed apertures 60*a*, 60*b*, and 60*c*. Hooked member 56 engages side panel 60 by protruding into one of these apertures, such as aperture 60*b*. Once the hooked members of the remaining assemblies 48 engage apertures in other side panels in the same manner, the burial vault is hoisted such as shown in FIG. 1, whereby the burial vault 15, the vault cover 17, and the burial service units 12 and 14 are elevated together as a composite body. This composite body is then transported to the site of the grave G.

INDIVIDUAL BURIAL SERVICE UNITS AND MOTOR CONTROLLER (FIGS. 4–7A, 13, 13A, & 13B)

Figure 4:
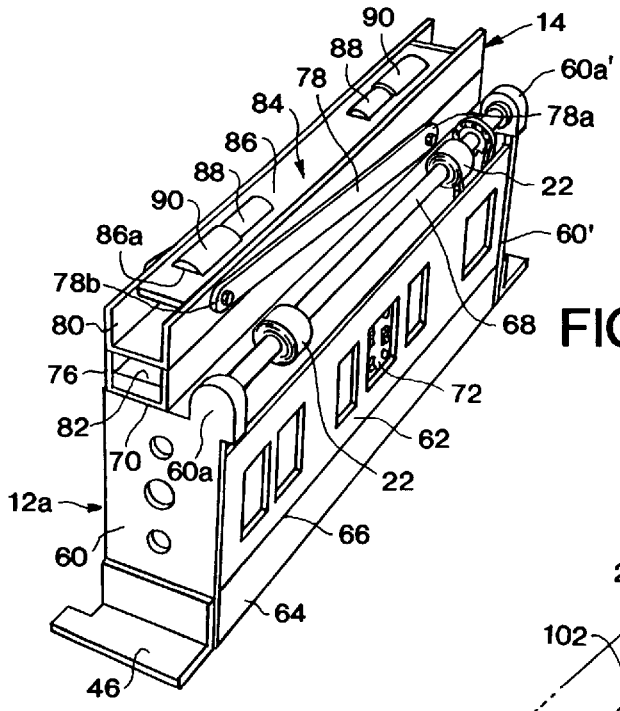
FIG. 4 is a perspective view of a burial service unit constructed in accordance with a preferred embodiment of the present invention.

FIG. 4, as compared to FIG. 5A, presents a somewhat more detailed perspective view of one of the burial service units, namely first burial service unit 12. Defining a substantial portion of the external configuration of unit 12 is a housing 12*a* comprised of side panels 60, 60', a front panel 62 connected at corresponding opposed ends to the side panels 60, 60', and a guard 64 hinged to front panel 62 at a lower edge 66 of the front panel 62. Front panel 62 carries a control panel 72, which will be described in greater detail with regard to FIG. 4A. The side panels 60, 60' may extend upwardly to form respective bearings 60*a*, 60*a'* in which a first shaft 68 is journaled. If desired, bearings 60*a*, 60*a'* may be separate pieces attached to an upper portion 70 of housing 12*a*, rather than being integral portions of side panels 60, 60', respectively. First shaft 68 carries the sources 22 of the flexible casket support members 20.

Also shown in FIG. 4 is a track assembly 74 mounted atop the housing 12*a*. The track assembly 74, which aids in vault cover positioning during a burial service in a manner to be described in detail herein, is comprised of a first track segment 76 secured to the upper portion 70 of the housing 12*a*, a link 78 having opposed ends 78*a* and 78*b*, the link 78 being pivotally connected at end 78*a* to the first track segment 76, and a second track segment 80 pivotally connected to end 78*b* of link 78. A stop block 82 is pivotally mounted to first track segment 76, as will be explained in greater detail with regard to FIG. 13. When the track assembly 74 assumes the retracted position shown, a removable guide roller assembly 84 is nested in the second track segment 80. Guide roller assembly 84 comprises a plate 86 having cut-out sections, such as at 86*a*, which accommodate a pair of strap guide rollers 88 and a pair of casket guide rollers 90. Support rollers 88 prevent the flexible casket support members 20 (FIG. 5) from scraping against the upper edge of the second track segment 80 when in use, and casket rollers 90 facilitate positioning of a casket onto flexible casket supports 16 (FIG. 5A).

Figure 6F:
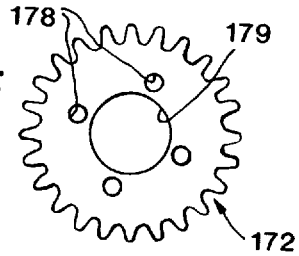
FIG. 6F is a front view of a vault drive sprocket used in a burial service unit constructed in accordance with the preferred embodiment of the present invention.
Figure 6E:
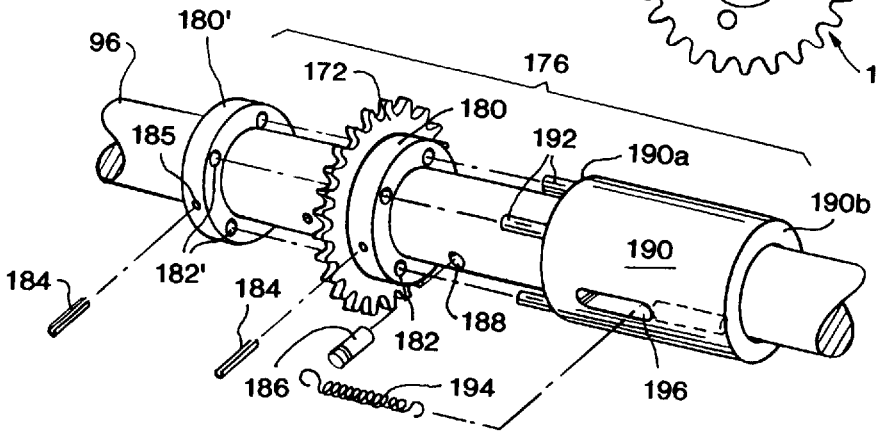
FIG. 6E is an exploded view of a drive disengagement mechanism.
Figure 6:
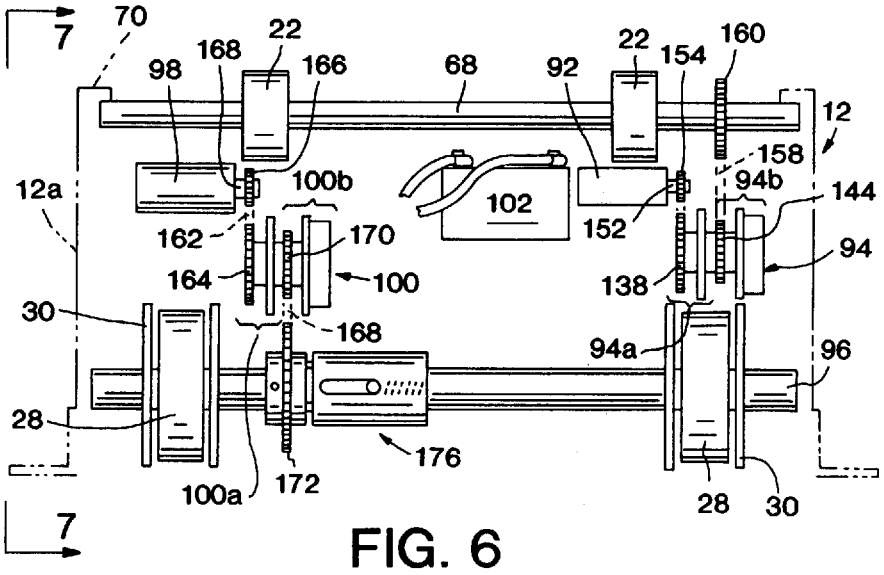
FIG. 6 is a front view of the automatic drive systems illustrated in FIG. 5.
Figure 7A:
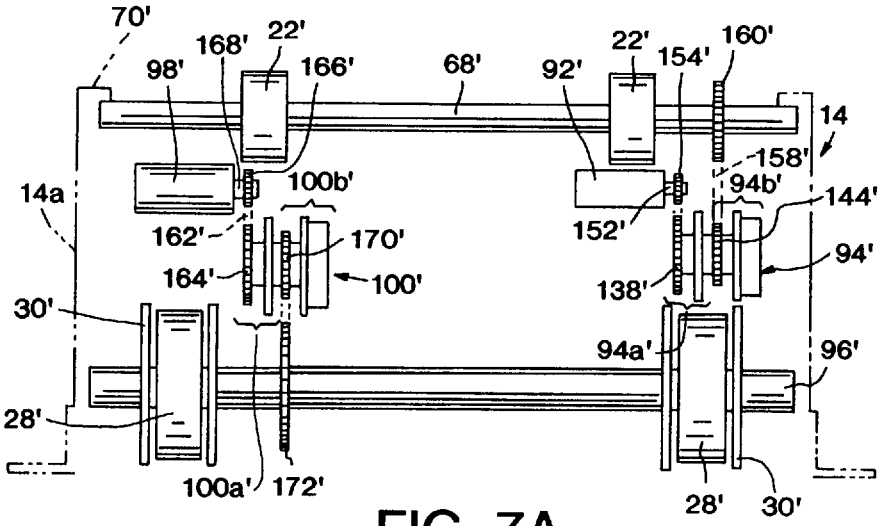
FIG. 7A is a front view of the automatic drive systems of another burial service unit.
Figure 7:
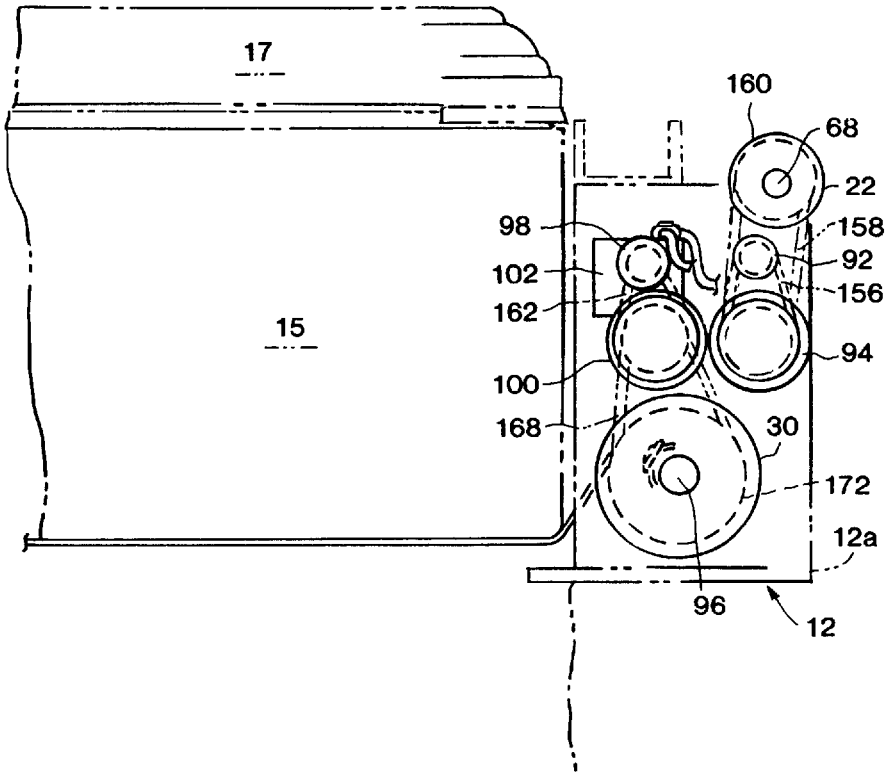
FIG. 7 is a side elevation view taken along line 7—7 in FIG. 6.

Referring to FIGS. 5, 6, & 7, the first burial service unit 12 includes a first automatic drive system operatively connected to the first shaft 68, comprising a first motor 92 carried by a panel of the housing 12*a* and a first transmission 94 also carried by a panel of the housing 12*a*, the first transmission 94 having a first input section 94*a* operatively connected to the first motor 92 and a first output section 94*b* operatively connected to the first shaft 68. Similarly, unit 12 also includes a second shaft 96 journaled in housing 12*a* and a second automatic drive system operatively connected to the second shaft 96. Second shaft is shown to carry spools 30, around which are wound the flexible vault support members 28; hence, the spools 30 form the preferable source of the vault support members 28 dispensed from unit 12 when in use. The second automatic drive system includes a second motor 98 carried by a panel of housing 12*a* and a second transmission 100 also carried by a panel of housing 12, the second transmission having a second input section 100*a* operatively connected to the second motor 98 and a second output section 100*b* operatively connected to the second shaft.

The first motor 92 is preferably a 1/30 horsepower, 50 rpm reversible electric motor with a 63:1 ratio, sold by Dayton Motor Co. of Dayton, Ohio under Model No. 1L476. The second motor 98 is preferably a 1/8 horsepower, 60 rpm reversible electric motor with a 56:1 ratio, sold by Dayton Motor Co. of Dayton, Ohio under Model No. 1L470. Both motors are operatively connected to a battery 102 supported by both front plate 62 and a rear plate (not shown) of housing 12*a*. Battery 102 is preferably a 12-volt battery of the gel-cell variety.

Figure 6A:
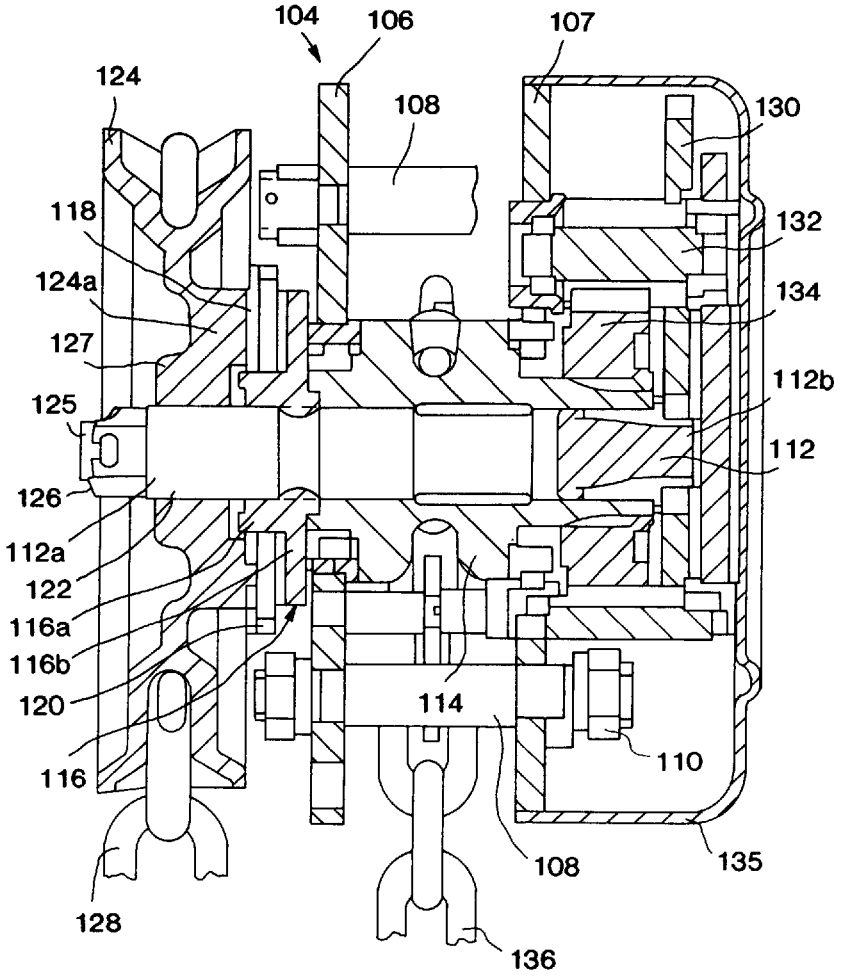
FIG. 6A PRIOR ART
FIG. 6A is a sectional elevation view of a chain-fall transmission constructed according to the prior art.
Figure 6C:
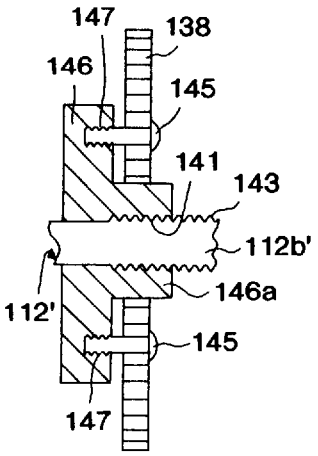
FIG. 6C is a sectional elevation view showing interaction between an externally threaded portion of a drive shaft and an internally threaded portion of a drive sprocket hub.
Figure 6B:
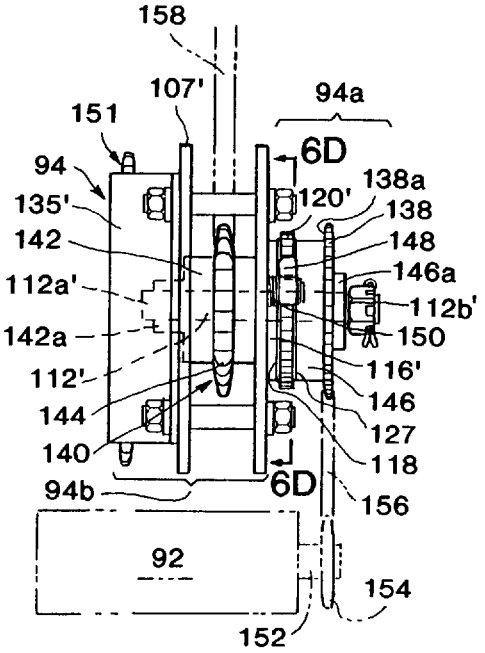
FIG. 6B is a side elevation view of one of the transmissions constructed in accordance with the preferred embodiment of the present invention, seen from a rear side of a first burial service unit.
Figure 6D:
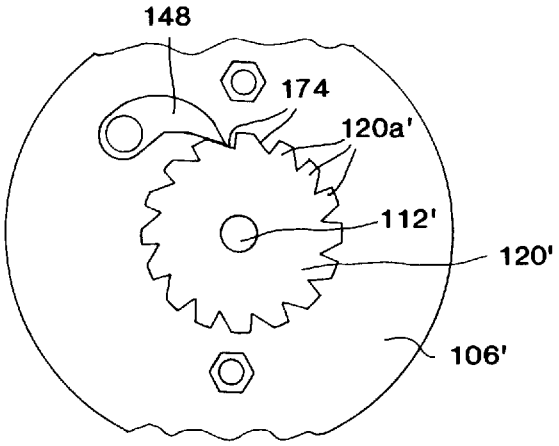
FIG. 6D is a sectional elevation view taken along line 6D—6D in FIG. 3B.

Referring to FIGS. 6A & 6B, the configuration of a transmission constructed according to the invention will now be described and compared to a prior art chain-fall transmission.

A prior art chain-fall transmission 104 (FIG. 6A) includes a pair of circular bearing plates 106, 107, each bearing plate being connected to corresponding ends of spacers 108 such as by bolts 110. Centrally received through these bearing plates are a drive shaft 112 having an externally-threaded end 112*a* and an annular load sprocket 114 disposed circumferentially about the drive shaft 112. Circumferentially attached to the drive shaft 112 axially adjacent the annular load sprocket 114 is a collar 116 having a hub 116*a* and a circular flange 116*b*. A pawl disc 120, together with an inner friction plate 118 and an outer friction plate 127 disposed axially adjacent either side of pawl disc 120, are received on hub 116*a*, and are freely rotatable thereabout. An internally-threaded sleeve 122, threadably received on externally-threaded end 112*a* of drive shaft 112, is prevented from dislodging entirely from end 112*a* by a pin 124 and a nut 126. A hand wheel 124 having a brake seat portion 124*a* is circumferentially attached to the sleeve 122. An end 112*b* of the drive shaft 112 opposite end 112*a* meshes with a disk gear 130, which meshes with a pinion shaft 132. The pinion shaft 132 meshes with a spline gear 134 circumferentially attached to the load sprocket 114. The disk gear 130, the pinion shaft 132, and the spline gear 134, collectively comprising a gear reduction mechanism, may all be housed within a housing 135 attached to bearing plate 107. Thus, turning the hand wheel 124 clockwise, such as with a hand chain 128, causes the hand wheel 124 and to travel axially to the right, thereby causing brake seat portion 124*a* to exert pressure against outer friction plate 127, pawl disc 120, inner friction plate 118, and collar 116, causing rotation thereof which, in turn, causes rotation of drive shaft 112. Such rotation, through the action of the gear reduction mechanism residing in housing 135, causes rotation of load sprocket 114, enabling lifting of an object with a load chain 136 operatively attached to the load sprocket 114.

Referring to FIG. 6B, a transmission constructed according to the present invention, such as first transmission 94, seen as if viewed from a rear side of first unit 12, is a modified form of the transmission 104 in FIG. 6A, to the extent that a drive sprocket 138 substitutes for the aforementioned hand wheel 124, and collar-sprocket assembly 140 axially spaced along a drive shaft 112' from the drive sprocket 138 substitutes for the aforementioned annular load sprocket 114. The elements of transmission 94 identified by primed numerals in FIG. 6B are identical to the elements identified by corresponding unprimed numerals in FIG. 6A.

The collar-sprocket assembly 140 includes an annular collar 142 circumferentially disposed about the drive shaft 112' and having a reduced end portion 142*a* communicating with a gear reduction mechanism 151 housed within housing 135'. Assembly 140 also includes a central sprocket 144, which is preferably a No. 25 sprocket having 36 teeth, circumferentially mounted to the collar 142. As best seen in FIG. 6C, drive sprocket 138, which is also preferably a No. 25 sprocket having 36 teeth, is attached adjacent its interior face 138*a* to a circular brake seat 146, a portion of which extends axially outwardly to form a hub portion 146*a*. Such attachment is provided by threaded fasteners 145 passing through drive sprocket 138 and engaging threaded bores 147 within the brake seat 146. Circular brake seat 146, including its hub portion 146*a*, has internal threads 141, such that it is threadably received on an end 112*b'* of drive shaft 112', end 112*b'* having external threads 143. Other elements of transmission 94 include a pawl disc 120' disposed circumferentially and freely rotatable about drive shaft 112' axially intermediate the brake seat 146 and the collar 142, respective inner and outer friction plates 118', 127' disposed axially adjacent either side of pawl disc 120', and a pawl 148 mounted to bearing plate 106' and biased into contact with the teeth of pawl disc 120' by a spring 150.

The principal elements of first transmission 94 having been described, the connections between a transmission and its associated shaft and motor are more easily explained. As seen in FIG. 6B, first motor 92 includes a first motor drive shaft 152, an end of which carries a first motor sprocket 154. A first chain 156 operably connects the motor sprocket 154 and the drive sprocket 138 comprising part of the first input section 94*a* of first transmission 94. A second chain 158 operably connects central sprocket 144, which comprises part of the first output section 94*b* of first transmission 94, to a casket drive sprocket 160 (FIG. 6) circumferentially mounted to the first shaft 68.

The second transmission 100 (FIG. 6) is operably connected to the second motor 98 and to the second shaft 96 in like manner. Specifically, a third chain 162 connects a drive sprocket 164 in second input section 100*a* to a second motor drive sprocket 166 carried on a second motor drive shaft 168 of second motor 98, and a fourth chain 168 connects a sprocket 170 in second output section 100*b* to a vault drive sprocket 172 circumferentially mounted to the second shaft 96.

First transmission 94, as well as the remaining transmissions in the preferred embodiment of the present invention, acts as both a power transmission mechanism and as a braking mechanism. When the brake seat 146 and the outer friction plate 127' exert pressure against pawl disc 120', uncontrolled rotation of the assembly 140 in a counterclockwise direction (viewing from the right side of FIG. 6B) is prevented by engagement of a pawl 148 with the pawl disc 120', as best seen in FIG. 6C. Such action therefore prevents uncontrolled descent of a casket positioned upon flexible supports 16 (FIG. 5A). Casket descent is controlled by selective disengagement of the brake seat 146 from pawl disc 120'. Such selective disengagement is provided through activation of first motor 92 such that motor shaft 152, and thus motor sprocket 154, turn in a counterclockwise direction, imparting like motion to drive sprocket 138 through first chain 156, thereby causing the drive sprocket 138 and brake seat 146 (hereinafter collectively referred to as a "drive sprocket assembly") to move axially to the right of FIG. 6B along the external threads of end 112*b'* of drive shaft 112'. Once such action occurs, the drive shaft 112', and thus the central sprocket 144, are free to rotate in a counterclockwise manner independently of pawl disc 120'; continued rotation of central sprocket 144 in a counterclockwise manner at a rate greater than the rate of rotation of the drive sprocket 138, however, causes the drive sprocket assembly to move axially to the left, owing to the interaction of the mating threads on drive shaft end 112*b'* and hub 139, whereby the drive sprocket assembly again contacts and exerts pressure against pawl disc 120', such that the engagement of pawl 148 with pawl disc 120' again prevents rotation of the drive shaft 112' and central sprocket 144 in a counterclockwise manner, thus providing braking action against further descent of the casket.

To move first shaft 68 in a direction opposite to that described above, i.e., to raise a casket, the first motor 92 is activated such that motor shaft 152 and first motor sprocket 154 are caused to move in a clockwise direction, imparting like motion to drive sprocket 138, drive shaft 112', and central sprocket 144. It will be appreciated that the pawl 148 does not prevent pawl disc 120' from also rotating in such a direction, since the pawl 148 slides along ramp portions 174 of the teeth 120*a'* of pawl disc 120' (FIG. 6C).

Finally shown in FIG. 6, the first unit 12 also includes a drive disengagement mechanism 176 mounted to the second shaft 96. As will be seen, drive disengagement mechanism 176 allows manual rotation of second shaft 96 independently of the vault drive sprocket 172, which may be desirable to save battery power which would otherwise be spent in retracting flexible vault support members 28 after use.

Referring to FIGS. 6E & 6F, drive disengagement mechanism 176 is shown in greater detail. To cooperate with this mechanism, vault drive sprocket 172 is provided with a plurality of circumferentially-spaced apertures 178 formed therein, as well as with a central aperture 179 for receiving second shaft 96. A first receptacle collar 180 is mounted to the second shaft 96 adjacent the vault drive sprocket 172, the receptacle collar 180 having a plurality of holes 182 therein aligning with the plurality of apertures 178 in the vault drive sprocket 172. Preferably, a second receptacle collar 180' of identical construction is also mounted to the second shaft 96 adjacent the other side of the vault drive sprocket 172. Both receptacle collars 180, 180' may attached to the second shaft 96 by retaining pins, such as shown at 184, extending into radial collar apertures such as at 185. Another pin 186 is mounted in an accommodating bore 188 in the second shaft 96, such that it projects radially from the second shaft 96 and that it is spaced axially from the first receptacle collar 180. An engagement sleeve 190 is slidably mounted along the second shaft 96 and has one end 190*a* from which extends a plurality of projections 192 aligning with the plurality of apertures 178 in the vault drive sprocket 172, and thus also with the plurality of holes 182 in the first receptacle collar 180. A spring 194 interconnects pin 186 and another end 190*b* of the engagement sleeve 190, whereby the spring 194 biases end 190*a* of engagement sleeve 190 against the first receptacle collar 180, such that the plurality of projections 192 extends through the corresponding plurality of holes 182 in the first receptacle collar and into the plurality of apertures 178 in the vault drive sprocket 172. Of course, if the second receptacle collar 180' is used, it is understood that the projections 192 would also extend into the plurality of holes 182' in the second receptacle collar 180'. When the sleeve 190 is biased in the manner described, the second shaft 96 can only rotate if the vault drive sprocket 172 is also caused to rotate. To enable the second shaft 96 to move independently of the vault drive sprocket 172, sleeve 190 is moved axially along the second shaft 96, to the extent permitted by a slot 196 formed into the sleeve 190, against the force of spring 194 so as to disengage the projections 192 from the apertures 178 and the holes 182.

FIG. 7A shows that the construction of second burial service unit 14 is identical to that of the first burial service unit 12, except that unit 14 is not provided with a battery, a control panel, or a drive disengagement mechanism. The components of second unit 14, which are identical to the corresponding components of the first unit 12, are identified by primed numerals in FIG. 7A directly corresponding to the unprimed numerals in FIG. 6A. Second unit 14 comprises a second housing 14*a* having a second upper portion 70', a third shaft 68' journaled in the second housing 14*a*, a third automatic drive system operatively connected to the third shaft 68', a second flexible casket support member 22' carried by the third shaft 68', a fourth shaft 96' journaled in the second housing 14*a*, a fourth automatic drive system operatively connected to the fourth shaft 96', and a second flexible vault support member 28' carried by the fourth shaft 96'. The third automatic drive system includes a third motor 92' carried by a panel of the second housing 14*a* and a third transmission 94' also carried by a panel of the second housing 14*a,* the third transmission 94' having a third input section 94*a'* operatively connected to the third motor 92' and a third output section 94*b'* operatively connected to the third shaft 68'. Similarly, the fourth automatic drive system includes a fourth motor 98' carried by a panel of the second housing 14*a* and a fourth transmission 100' also carried by a panel of the second housing 14*a,* the fourth transmission 100' having a fourth input section 100*a'* operatively connected to the fourth motor 98' and a fourth input section 100*b'* operatively connected to the fourth shaft 96'.

Figure 4A:
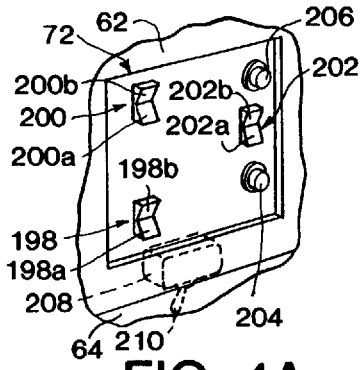
FIG. 4A is an enlarged perspective view of a master control panel for a motor controller.
Figure 4B:
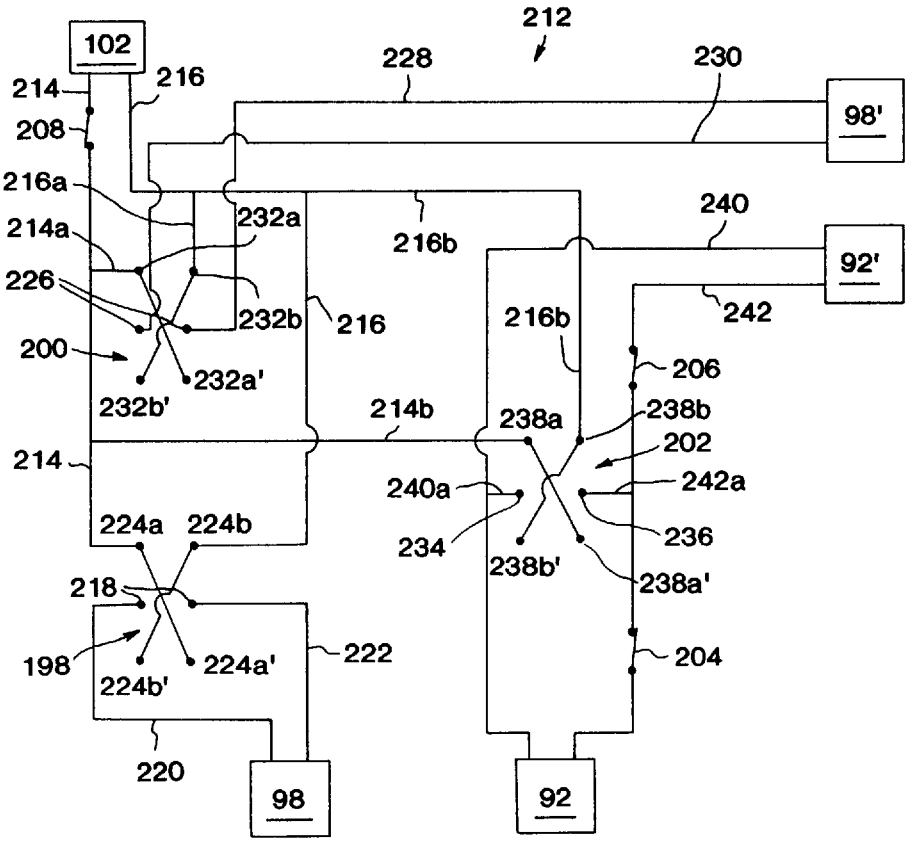
FIG. 4B is an electrical diagram illustrating the arrangement of an electrical system powering a burial service system constructed in accordance with a preferred embodiment of the present invention.

Referring to FIGS. 4A & 4B, the electrical motor controller, or electrical controlling system, which is adapted to selectively control activation of each of the motors 92, 92', 98, 98,' of the burial service system 10, will now be described.

As seen in FIG. 4A, the control panel 72, carried by the first unit 12, includes a first vault control switch 198, operatively connected to the second motor 98, a second vault control switch 200 operatively connected to the fourth motor 98', and a casket control switch 202 operatively connected to the first motor 92 and to the third motor 92'. Switches 198, 200, 202 are preferably each constructed as an on-off-on switch such that these switches have respective lower portions 198*a,* 200*a,* 202*a,* and respective upper portions 198*b,* 200*b,* 202*b.* In the neutral switch positions shown in FIG. 4A, no motor is activated. Pressing lower portion 198*a* of first vault control switch 198, however, causes second motor 98 to selectively release the braking action of second transmission 100 (FIG. 6), enabling second shaft 96 to rotate in a direction to dispense flexible members 28 (FIG. 5), thereby lowering an end of a supported burial vault proximate first unit 12; pressing upper portion 198*b* actuates second motor 98 in an opposite direction, thereby causing second shaft 96 to raise the end of the supported burial vault proximate first unit 12. Similarly, pressing lower portion 200*a* of second vault control switch 200 causes fourth motor 98' (FIG. 7A) to selectively release the braking action of fourth transmission 100', enabling shaft 96' to rotate in a direction to dispense flexible members 28', thereby lowering an end of a supported burial vault proximate second unit 14; pressing upper portion 200*b* actuates fourth motor 98' in an opposite direction, thereby causing fourth shaft 96' to raise the end of the supported burial vault proximate second unit 14. Hence, the switches 198, 200 enable opposed ends of a burial vault supported on flexible vault support members 18 (FIG. 5A) to be raised and lowered independently of one another to conform to a particular grade of the grave in which the burial vault is to be lowered.

Regarding the casket control switch 202, pressing lower portion 202*a* simultaneously causes both first motor 92 and third motor 92' to selectively release the braking action of their associated transmissions 94, 94', permitting dispensing of flexible casket support members 20, 20' (FIG. 5A) from the first shaft 68 and third shaft 68', respectively, thus causing uniform lowering of a supported casket. Conversely, pressing upper portion 202*b* causes first motor 92 and third motor 92' to impart rotation to associated shafts 68, 68' so as to uniformly raise the casket. Though the casket control switch 200 simultaneously controls both motors 92, 92', one motor may run independently of the other motor to enable positioning of the casket in accordance with a grade of the grave. This capability is afforded by a first deactivation means, or first kill switch, 204, and a second deactivation means, or second kill switch, 206, both kill switches also being carried by the control panel 72. Pressing kill switches 204, 206 terminates power to first motor 92 and to third motor 92', respectively, as will be more clearly seen in FIG. 4B.

Finally shown in FIG. 4A is a toggle switch 208 communicating with the motor controller for selectively terminating power to all of the motors 92, 92', 98, 98' in the burial service system 10. The toggle switch 208 is carried by control panel 72 behind the front panel 62 of first burial service unit 12, and is accessible by lifting the hinge-mounted guard 64 and by flipping lever 210. It will be appreciated that provision of a toggle switch arranged in the manner shown prevents inadvertent activation of any of the system motors.

Referring to FIG. 4B, the operative connections of the switches to their associated motors are more clearly seen. Motor controller 212 includes a power source, preferably battery 102, connected to switches 198, 200, 202 by first and second main power lines 214, 216 and by branching power lines 214*a,* 214*b* and 216*a,* 216*b* extending respectively therefrom. Toggle switch 208 is shown as an on-off switch communicating with main power line 214; however, toggle switch 208 may reside in either main power line and still accomplish its intended purpose.

First vault control switch 198 includes a pair of load contacts 218 connected to second motor 98 via load lines 220, 222, power contacts 224*a,* 224*a'* connected to the battery 102 via main power line 214, and power contacts 224*b,* 224*b'* connected to the battery 102 via main power line 216. From this on-off-on configuration, it will be appreciated that the polarity of electrical current flowing through second motor 98, when switch 198 brings contacts 218, 224*a,* 224*b* into electrical communication with one another (preferably initiating a vault end raising mode), is reversed when switch 198 instead brings contacts 218, 224*b'*, 224*a'* into electrical communication with one another (preferably initiating a vault end lowering mode).

The operative connections concerning second vault control switch 200 are similar to those described above with respect to first vault control switch 198. Specifically, second vault control switch 200 includes a pair of load contacts 226 connected to fourth motor 98' via load lines 228, 230, power contacts 232*a,* 232*a'* connected to the battery 102 via power lines 214, 214*a,* and power contacts 232*b,* 232*b'* connected to the battery 102 via power lines 216, 216*a.*

Regarding casket control switch 202, the operative connections are similar to those hereinabove described, but differ to the extent that a single switch is electrically connected to two motors. Casket control switch 202 includes a pair of load contacts 234, 236, power contacts 238*a,* 238*a'* connected to the battery 102 via power lines 214, 214*b,* and power contacts 238*b,* 238*b'* connected to the battery 102 via power lines 216, 216*b.* First and second load lines 240, 242, respectively, electrically connect first motor 92 and third motor 92' to each other. Load contact 234 communicates with first load line 240 via a branch 240*a,* and load contact 236 communicates with second load line 242 via a branch 242*a.* First kill switch 204 is operatively connected to the first motor 92 in that it interrupts second load line 242 intermediate the casket control switch 202 and first motor 92, while second kill switch 206 is operatively connected to the third motor 92' in that it interrupts second load line intermediate the casket control switch 202 and the third motor 92'. Both kill switches 204, 206 are normally-closed momentary switches, meaning that they are brought to an open position only so long as their respective actuating buttons (FIG. 4A) are depressed. It will be appreciated that when constructed in the manner shown in FIG. 4B, casket control switch 202 simultaneously actuates first and third motors 92, 92' in one direction when contacts 234, 236, 238*a,* 238*b* are brought into electrical communication with one another, and that the switch 202 simultaneously actuates first and third motors 92, 92' in an opposite direction when contacts 234, 236, 238*b'*, 238*a'* are brought into electrical communication with one another.

METHOD OF LOWERING CASKET AND VAULT INTO GRAVE

(FIGS. 8, 9, 9A, 10, 10A, 11, 12, 13, & 13A)

Figure 8:
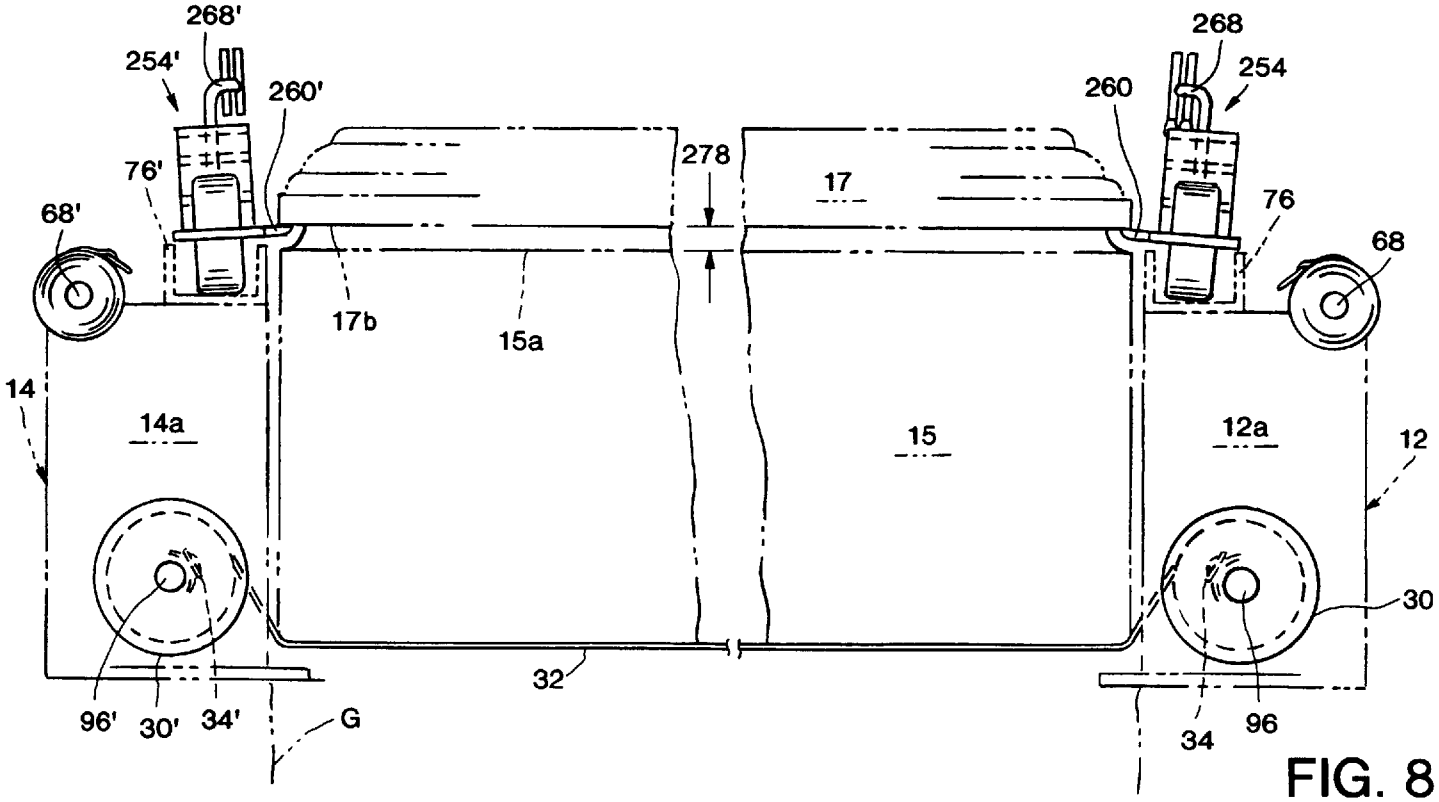
FIG. 8 is a side elevation view illustrating an initial step in the separation of a vault cover from a burial vault.

Referring to FIG. 8, removable intermediate vault support member 32 is shown as having been attached via buckles 34, 34' to the flexible vault support members 28, 28' (FIG. 5A) respectively dispensed from spools 30, 30' carried by shafts 96, 96' of the first unit 12 and second unit 14, respectively. In the position shown in FIG. 8, the buckles 34, 34' are radially close to associated shafts 96, 96'. The attachment of member 32 may be done prior to the transport of the burial service system 10 previously described with regard to FIGS. 1, 2, 3, & 3A. Also preparatory to transport, the burial vault 15 with vault cover 17 may be placed onto the attached intermediate member 32 in the manner shown in FIG. 8, where the burial vault 15 is shown supported by member 32 above the opening of the grave G. At the site, first unit 12 is shown as having been positioned proximate one end of the grave G, while the second unit 14 is shown as having been positioned proximate another end of the grave G, such that the first unit 12 and the second unit 14 are spaced from one another across the grave G.

Once the units 12, 14 are positioned in the manner described with regard to FIG. 8, the respective track assemblies of the units are extended from the retracted position shown in FIG. 4 to an extended position. To bring a track assembly to an extended position, as best seen in FIG. 13 with regard to the first unit 12, the second track segment 80 of track assembly 74 is lifted from first track segment 76 and then oriented such that link 78 is brought to a substantially horizontal position, roughly parallel to a longitudinal axis of the first track segment 76. In this extended position, the first track segment 76 and the second track segment 80 form one continuous track. Stop block 82 rests on web portion 76*a* of first track segment 76 and is seen to be pivotally mounted at 244 to flanges 76*b* of first track segment 76, whereby it may be flipped either to the outward position shown in solid lines or to the inward position shown in broken lines. In the outward position, stop block 82 laterally aligns the removable guide roller assembly 84 (FIG. 4) with respect to the burial vault 15 by abutting the removable guide roller assembly 84 against hinged end 82*a* of stop block 82. The inner position of the stop block aligns a cover trolley, to be described in detail below.

Figure 13B:
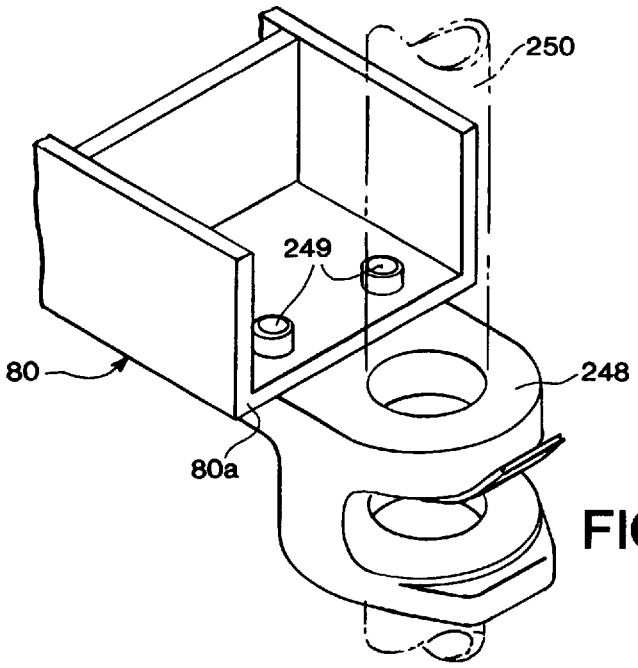
FIG. 13B is a perspective view detailing an eye member attached to an end of a track assembly segment.

As seen in FIGS. 13, 13A, & 13B, the extended track assembly 74 is supported not only by the first burial unit 12 but also by a support assembly 246 engaging a free end of second track segment 80. Support assembly 246 includes an eye portion 248 attached as by fasteners 249 to the second track segment 80, proximate its free end 80*a*, and a pole 250 engaging the eye portion 248. A base 252 communicates with a lower end of pole 250 to evenly distribute the load acting through the pole 250.

Referring to FIG. 13, the extended track assembly 74 accommodates a cover trolley 254, which is movable along track assembly 74 in the direction indicated by arrows 256, and which is adapted to engage vault cover 17. As seen in FIG. 13A, cover trolley 254 is accommodated by track segments 76, 80 of the first burial service unit 12, and another cover trolley 254' is accommodated by identically-constructed track segments 76', 80' of the second burial service unit 14.

Figure 9:
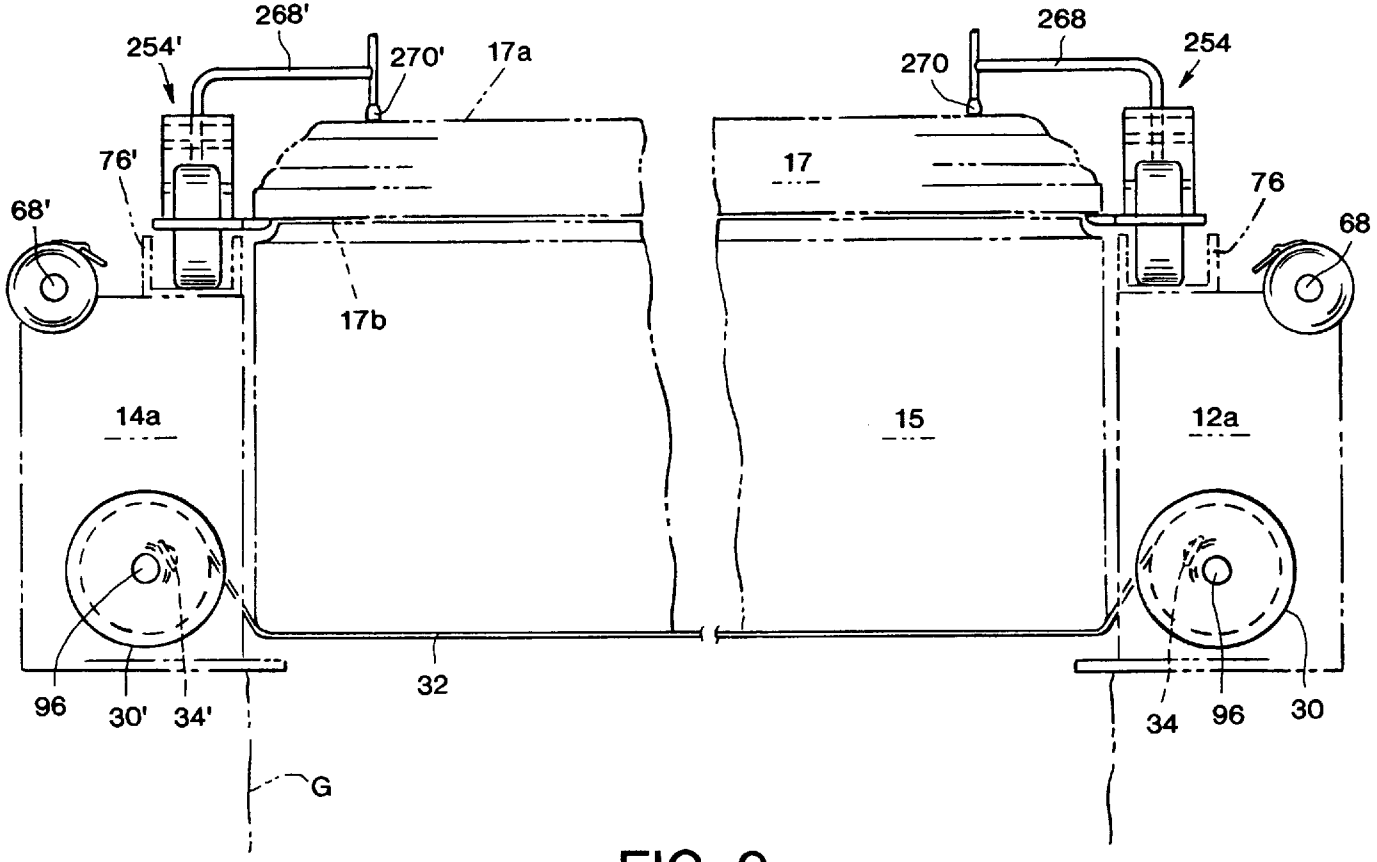
FIG. 9 is a side elevation view, similar to FIG. 8, illustrating a subsequent step in the separation of a vault cover from a burial vault.
Figure 9A:
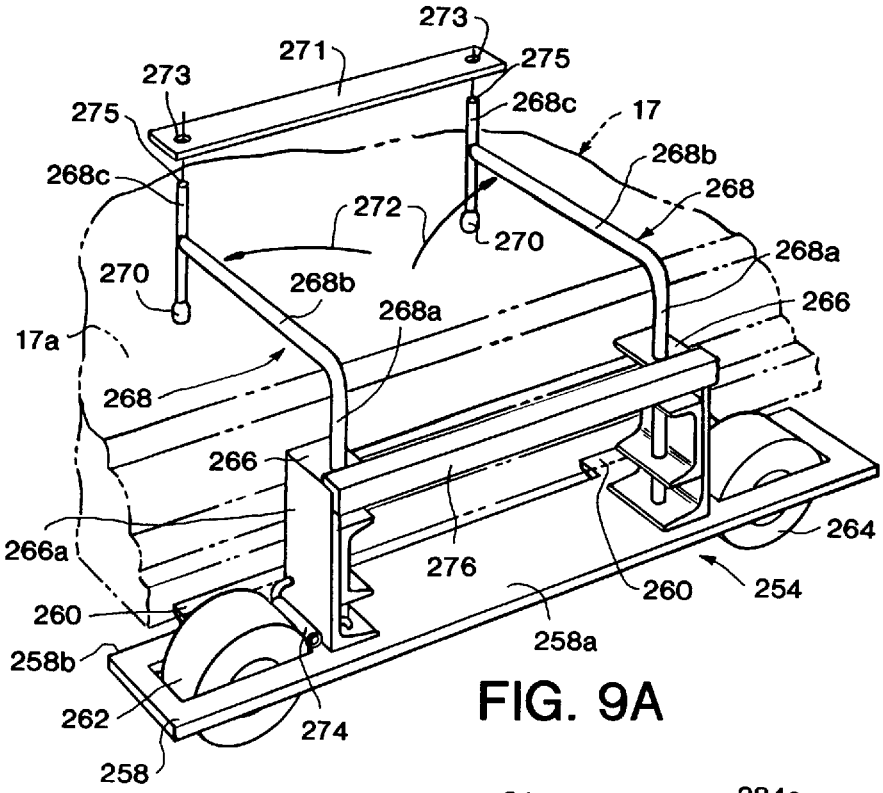
FIG. 9A is a perspective view of a cover trolley constructed in accordance with a preferred embodiment of the present invention.

Referring to FIG. 9A, cover trolley 254 comprises a base 258 having an upper surface 258*a* and a lateral side 258*b*. Portions of lateral side 258*b* extend outwardly to form engaging tabs 260. Base 258 carries wheels 262, 264. Additionally, supports 266 are mounted to upper surface 258*a*, each support having a side wall 266*a*. Clamping arms 268 are rotatably mounted in each of the supports 266 to engage an upper surface 17*a* the vault cover 17. Each clamping arm 268 includes a stem 268*a* received in apertures in the supports 266, a portion of the stem bending to form a horizontal portion 268*b*, and a vertical member 268*c* attached to a free end of the horizontal member 268*b*. Preferably, a cap 270 is received on the lower end of each vertical member 268*c* to prevent scratching of the cover surface 17*a*. Thus, the clamping arms 268 may be pivotally moved into and out of engagement with the vault cover 17, such movement being indicated by arrows 272. If the planar portion of upper surface 17*a* is of a relatively small width, a restraining bar 271 may be used to prevent the arms 268 from substantially rotating outwardly beyond the position shown. The restraining bar 271, being provided with an aperture 273 proximate each opposed end, is placed into operative position by first aligning each aperture 273 with a vertical member 268*c*, then by lowering the bar 271 into place such that it is disposed at an elevation between caps 270 and upper ends 275 of associated vertical members 268*c*. A brake 274 is pivotally mounted in the side wall 266*a* of each support 266, such that the brake 274 is adapted to be selectively moved into and out of engagement with an associated wheel 262, 264. When moving the cover trolley 254, the operator disengages the brake from the trailing wheel with respect to the intended direction of travel, but brings the other brake into engagement with the lead wheel; hence, the lead brake acts as a safety feature by preventing inadvertent movement of the cover trolley 254 in a direction opposite to that which is intended. When the cover trolley is to hold vault cover 17 in an at-rest position, both brakes engage their associated wheels to prohibit movement in either a forward or a backward direction. Finally, to enhance overall stability of the cover trolley 254, a brace 276 may be attached proximate its opposed ends to the upper portions of supports 266.

Referring to FIG. 13, once the track assembly 74 has been extended and a cover trolley 254 placed on the extended track assembly 74, the cover trolley 254 is laterally aligned with respect to the burial vault 15. This is accomplished by flipping the stop block 82 inwardly and abutting near wheel 262 of cover trolley 254 against the now-inwardly-flipped free end 8*b* of stop block 82.

Next, referring back to FIG. 8, the burial vault 15 is vertically positioned such that the respective engaging tabs 260, 260' of each cover trolley 254, 254' extend into a gap 278 between a square edge 15*a* of the burial vault 15 and the underside 17*b* of vault cover 17. As seen in FIG. 8, the cover trolleys 254, 254' are preferably canted slightly outwardly (away from the vault cover 17) so as to assure engagement of the engaging tabs 260, 260' with the vault cover underside 17*b*.

In FIG. 9, the burial vault 15 and vault cover 17 are lowered from the position shown in FIG. 8 such that the engagement of the vault cover underside 17*b* by the engaging tabs 260, 260' is enhanced owing to the fact that the weight of the cover 17 has moved the trolleys 254, 254, from their canted position in FIG. 8 to the upright position shown in FIG. 9, thus increasing the surface area of contact between the engaging tabs 260, 260' and the vault cover underside 17*b*. Hence, in the position shown, the trolleys 254, 254' prevent further descent of the vault cover 17. Moreover, FIG. 9 shows that continued lowering of the burial vault 15 for a time sufficient to completely separate vault cover 17 from the burial vault 15 has taken place. Such separation having occurred, the vault cover 17 is now completely supported by the cover trolleys 254, 254'. Preparatory to moving the vault cover 17 away from the vault, the cover trolleys are manipulated to grip the vault cover 17 more tightly. Specifically, the clamping arms 268, 268' are swung around to the respective positions shown in FIG. 9 such that the respective caps 270, 270' engage the upper surface 17*a* of the vault cover. Hence, the vault cover 17 is held between the engaging tabs 260, 260' and the clamping arms 268, 268' of each respective cover trolley 254, 254'.

The vault cover 17 having been clamped by the cover trolleys 254, 254' in the manner described above, it is moved away from burial vault 15. Referring to FIG. 13A, the vault cover 17 is shown to have been laterally displaced with respect to the burial vault 15 by the trolleys 254, 254' such that the vault opening 13 is now completely exposed. Also shown in FIG. 13A is the extension of flexible casket support 16, including removable intermediate casket support member 24 with cross members 24*a*, 24*b*, over the vault opening 13.

Figure 10A:
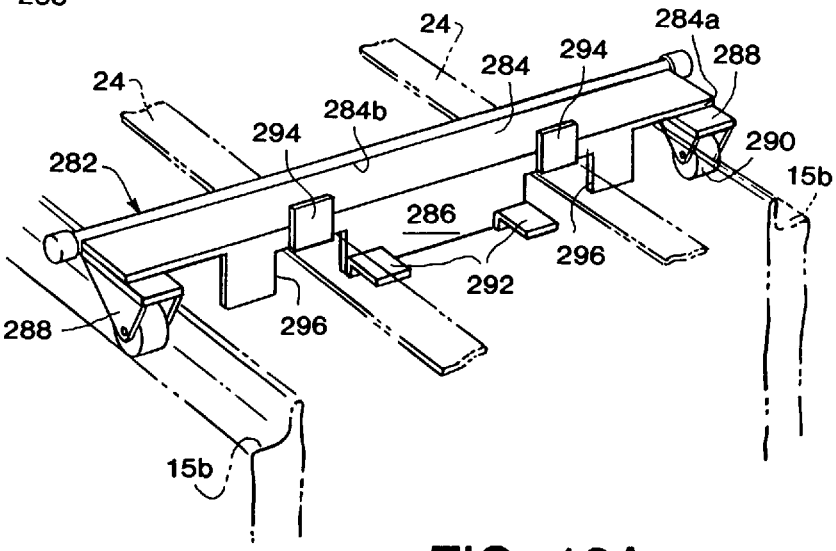
FIG. 10A is a perspective view of a casket bridge for accomplishing the casket positioning shown in FIG. 10.
Figure 10:
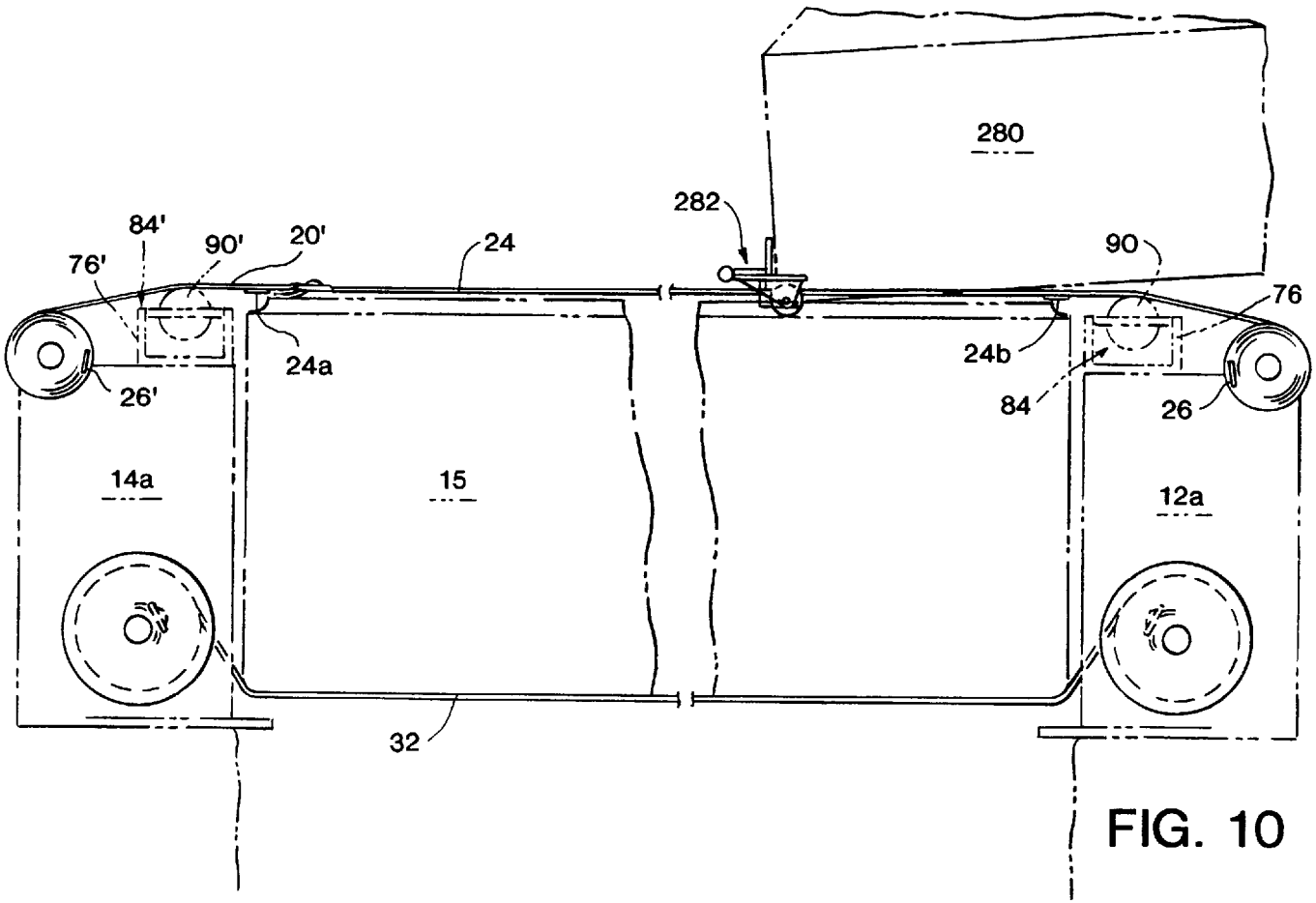
FIG. 10 is a side elevation view illustrating the positioning of a casket onto flexible casket supports spanning the opening of a partially lowered burial vault.

Referring to FIG. 10, the cover trolleys 254, 254' having been rolled off of the first track segment 76, 76' of each unit 12, 14, the removable guide roller assemblies 84, 84' are now placed so as to be nested in the respective first track segments 76, 76' in the manner shown. A casket 280 is placed onto flexible casket support 16, mainly intermediate member 24. Casket roller 90, being contacted by the underside of the casket 280, facilitates movement of the casket 280 from the right to the left of FIG. 10. Also aiding in such movement is a casket bridge 282, described in detail below.

Referring to FIG. 10A, casket bridge 282 is constructed of a bar 284 having a front side 284*a* and a rear side 284*b*, the front side 284*a* extending downwardly to form a flange member 286. Attached to the underside of bar 284 are roller frames 288 into which respective rollers 290 are journaled. Preferably, casket bridge 282 is also provided with casket rest members 292 affixed to a lower portion of flange member 286, and bumper stops 294 affixed to an upper portion of flange member 286. Bumper stops 294 are preferably constructed of elastomeric material. Additionally, cut-out sections 296 are preferably formed into flange member 286 to provide clearance for flexible casket support members 24. By virtue of such construction, casket bridge 282 is adapted to easily travel along a lip 15*b* of burial vault 15 to aid in the alignment of the casket 280 (FIG. 10) squarely over the burial vault opening 13 (FIG. 13A).

Figure 11:
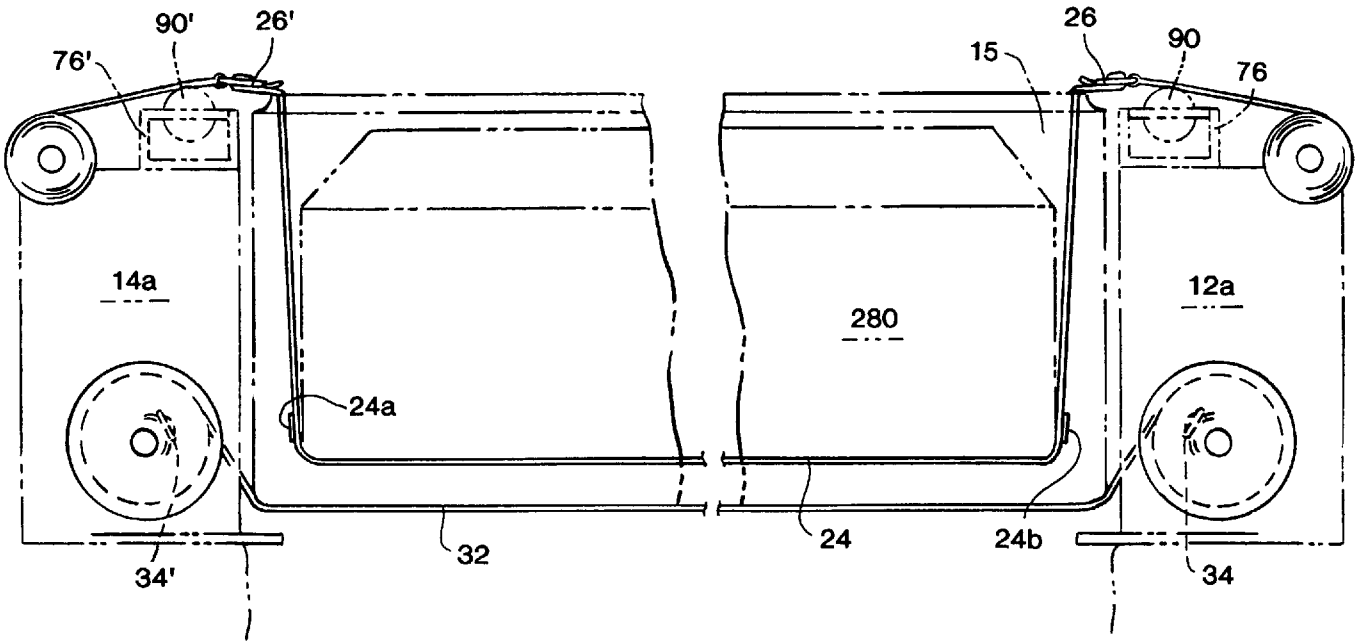
FIG. 11 is a side elevation view of a casket descending into a partially lowered burial vault.

Referring to FIG. 11, the casket 280 is shown being lowered into the burial vault 15. Once such lowering is completed, the casket is supported in the burial vault 15 by raised supports (not shown) attached to the floor of the burial vault 15, facilitating extrication of casket support member 16 (FIGS. 5A & 13A) from beneath the lowered casket.

The roller assemblies 84, 84' are then taken off of the respective first track segments 76, 76', and the respective stop blocks 82, 82' (FIG. 13A) are again flipped to an inward position. Next, the cover trolleys 254, 254' are moved laterally back to the position shown in FIG. 9, such that, by abutting against the stop blocks 82, 82', the vault cover 17 is aligned precisely over the vault opening 13.

Figure 12:
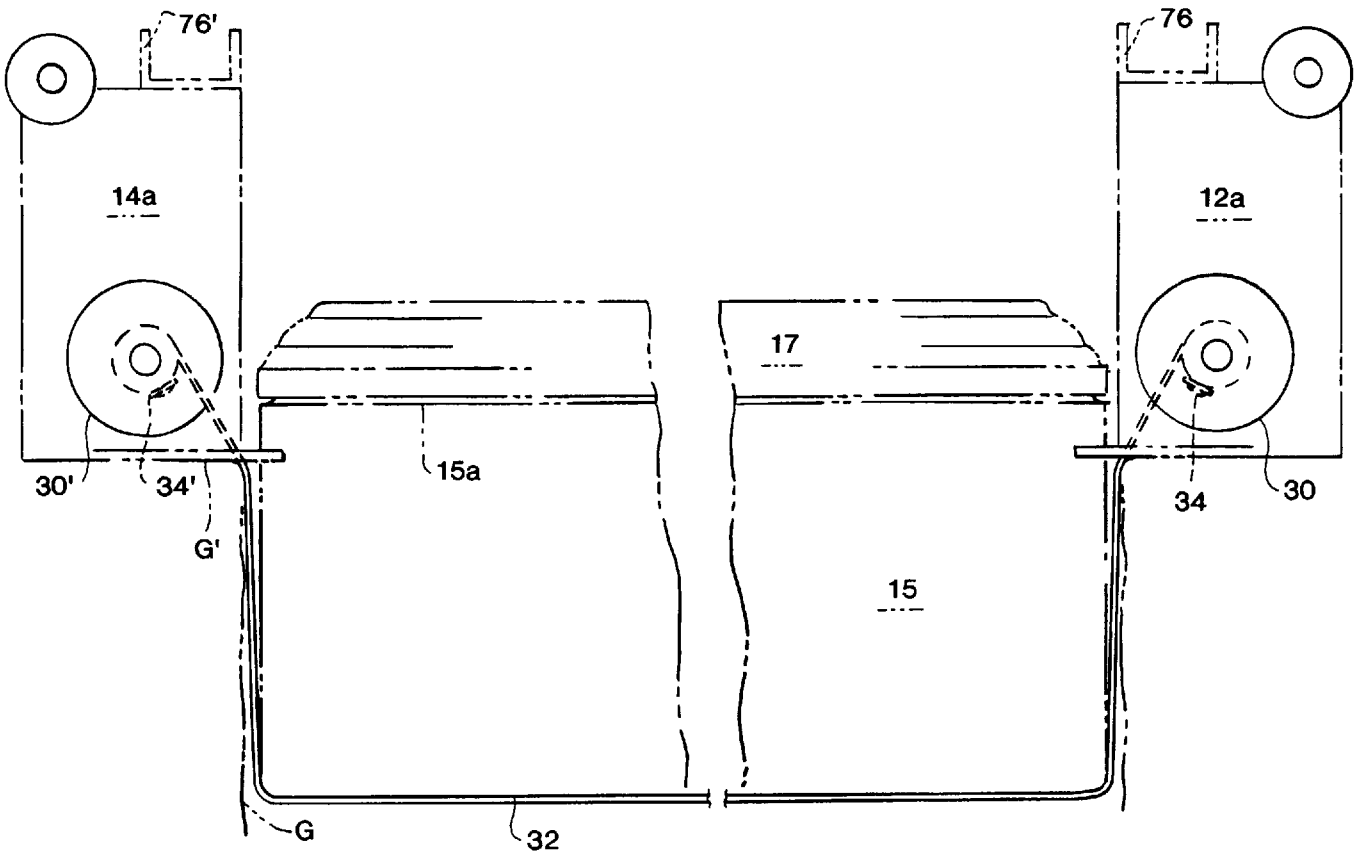
FIG. 12 is a side elevation view of a sealed burial vault descending further into a grave.

The units 12, 14 then raise the burial vault 15 up to the clamped burial vault cover 17 until the burial vault 15 and the vault cover 17 fully engage one another to provide a sealed burial vault, shown in FIG. 12. The cover trolleys 254, 254' are then disengaged from the vault cover 17. The sealed burial vault is then lowered into the grave G by the units 12, 14. The buckles 34, 34' will begin to be unwound from the reels 30, 30' when the square edge 15*a* of the burial vault 15 reaches grave grade level G'. The sealed burial vault is in the fully lowered position when edge 15*a* is about eighteen inches below grade level G'.

As the above description is merely exemplary in nature, being merely illustrative of the invention, many variations will become apparent to those of skill in the art. Such variations, however, are included within the spirit and scope of this invention as defined by the following appended claims.

That which is claimed:

1. A casket bridge for properly aligning a casket with respect to an opening of a burial vault, comprising:

a bar having a front side and a rear side, said front side extending downwardly to form a flange member; and a roller attached to said bar;

a casket rest member affixed to a lower portion of said flange member; and a bumper stop affixed to an upper portion of said flange member;

whereby said casket bridge is adapted to travel along a lip of said burial vault to align said casket.

2. The casket bridge set forth in claim 1, wherein a cut-out section is formed into said flange member to provide clearance for a flexible casket support member.

3. A method of transporting to a grave a burial vault having upper corner sections, together with a vault cover and a burial service unit, comprising the steps of:

placing a spacer block assembly onto each said upper corner section of said burial vault, each said spacer block assembly comprising a block, a flexible member attached at one end to said block, and a hooked member attached to another end of said flexible member;

placing said vault cover onto each said spacer block assembly;

providing said burial service unit with a housing having a side panel;

engaging said side panel with said hooked member;

hoisting said burial vault, whereby said burial vault, said vault cover, and said burial service unit are elevated together as a composite body; and transporting said composite body to said grave.

4. A method of lowering both a casket and a burial vault with a vault cover into a grave, comprising the steps of:

providing a first unit and a second unit, each said unit comprising:

a. a housing having an upper portion;

b. a first source carried by said housing, said first source dispensing a flexible casket support member;

c. a second source carried by said housing, said second source dispensing a flexible vault support member; and d. a track assembly mounted atop said housing and being movable from a retracted position to an extended position;

forming a vault support, said vault support including portions of flexible vault support members dispensed from each said second source of each said unit;

placing said burial vault with said vault cover onto said vault support;

positioning said first unit proximate one end of said grave and said second unit proximate another end of said grave, such that said first unit and said second unit are spaced from one another across said grave;

extending each said track assembly to said extended position;

providing a cover trolley for each said track assembly, each said cover trolley being movable along each track assembly and adapted to engage said vault cover;

vertically positioning said burial vault such that a portion of each said cover trolley extends into a gap between said burial vault and said vault cover;

further lowering said burial vault with said vault cover such that said portion of each said cover trolley engages said vault cover to prevent further descent of said vault cover;

continuing to lower said vault for a time sufficient to separate said vault cover from said burial vault;

displacing said vault cover away from said burial vault with each said cover trolley;

extending a flexible casket support over an opening of said burial vault, said flexible casket support including portions of flexible casket support members dispensed from each said first source of each said unit;

placing said casket onto said flexible casket support;

lowering said casket into said burial vault;

sealing said burial vault with said vault cover to provide a sealed burial vault; and lowering said sealed burial vault into said grave.

5. The method set forth in claim 4, wherein said step of providing a first unit and a second unit includes the step of constructing each said track assembly from:

a first track segment secured to said upper portion of each said housing;

a link having opposed ends, said link being pivotally connected at one end to said first track segment; and a second track segment pivotally connected to another end of said link.

6. The method set forth in claim 5, further comprising the step of laterally aligning each said cover trolley with respect to said burial vault.

7. The method set forth in claim 6, wherein said step of laterally aligning each said cover trolley with respect to said burial vault comprises the steps of:

pivotally mounting a stop block to each said first track segment, whereby said stop block may be flipped outwardly or inwardly;

flipping each said stop block inwardly; and abutting each said cover trolley against a corresponding stop block.

8. The method set forth in claim 6, further comprising the steps of:

providing a removable guide roller assembly per each said track assembly; and nesting each said removable guide roller assembly in said each first track segment when said each track assembly is extended to said extended position.

9. The method set forth in claim 8 further comprising the step of aligning each said removable guide roller assembly with respect to said burial vault by flipping said stop block.

10. A casket bridge for properly aligning a casket with respect to an opening of a burial vault, comprising:

a bar having a front side and a rear side, said front side extending downwardly to form a flange member; and a roller attached to an underside of said bar;

whereby said casket bridge is adapted to travel along a lip of said burial vault to align said casket.

* * * * *